US011282452B2

(12) United States Patent
Yin

(10) Patent No.: US 11,282,452 B2
(45) Date of Patent: Mar. 22, 2022

(54) PIXEL CIRCUITRY AND DRIVE METHOD THEREOF, ARRAY SUBSTRATE, AND DISPLAY PANEL

(71) Applicant: BOE TECHNOLOGY GROUP CO., LTD., Beijing (CN)

(72) Inventor: Xinshe Yin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 317 days.

(21) Appl. No.: 16/611,290

(22) PCT Filed: Mar. 28, 2019

(86) PCT No.: PCT/CN2019/080113
§ 371 (c)(1),
(2) Date: Nov. 6, 2019

(87) PCT Pub. No.: WO2019/242369
PCT Pub. Date: Dec. 26, 2019

(65) Prior Publication Data

US 2021/0407403 A1 Dec. 30, 2021

(30) Foreign Application Priority Data

Jun. 19, 2018 (CN) ..... 201810627050.0

(51) Int. Cl.
*G09G 3/3233* (2016.01)
*G09G 3/36* (2006.01)

(52) U.S. Cl.
CPC ..... *G09G 3/3233* (2013.01); *G09G 3/3618* (2013.01); *G09G 3/3655* (2013.01); *G09G 2300/0866* (2013.01)

(58) Field of Classification Search
CPC .. G09G 3/3233; G09G 3/3618; G09G 3/3655; G09G 2300/0866; G09G 3/30;
(Continued)

(56) References Cited

U.S. PATENT DOCUMENTS

2006/0118869 A1* 6/2006 Lan ..... H01L 29/6675 257/347
2006/0119548 A1* 6/2006 Lan ..... G09G 3/3233 345/76
(Continued)

FOREIGN PATENT DOCUMENTS

CN 104464615 A 3/2015
CN 104637440 A 5/2015
(Continued)

OTHER PUBLICATIONS

PCT International Search Report, Application No. PCT/CN2019/080113, dated Jun. 10, 2019, 5 pages: with English translation.
(Continued)

*Primary Examiner* — Richard J Hong
(74) *Attorney, Agent, or Firm* — Armstrong Teasdale LLP

(57) ABSTRACT

Embodiments of the present disclosure provide a pixel circuitry. The pixel circuitry includes a data write-in circuit, an initialization circuit, a sense circuit, a first capacitor, a second capacitor, a drive transistor, and a data signal supply circuit. The data write-in circuit supplies a data signal to a first node according to a first control signal. The initialization circuit supplies an initialization signal to a sense line according to a second control signal. The sense circuit couples a second node to the sense line according to the first control signal. The data signal supply circuit reads the voltage of the sense line according to a third control signal, determines a threshold voltage of the drive transistor according to the read voltage, and corrects an original data signal according to the threshold voltage to supply the corrected original data signal to the data line.

20 Claims, 8 Drawing Sheets

(58) Field of Classification Search
CPC .. G09G 3/3283; G09G 3/3659; G09G 3/3291; H04N 5/378; H04N 5/37452; H01L 29/6675; G06N 3/08
See application file for complete search history.

(56) References Cited

U.S. PATENT DOCUMENTS

| | | | | |
|---|---|---|---|---|
| 2007/0070006 | A1* | 3/2007 | Katayama | G09G 3/3659 345/88 |
| 2011/0227505 | A1 | 9/2011 | Park et al. | |
| 2013/0050292 | A1* | 2/2013 | Mizukoshi | G09G 3/3291 345/690 |
| 2015/0062137 | A1 | 3/2015 | Yu et al. | |
| 2015/0084946 | A1* | 3/2015 | Shim | G09G 3/3233 345/212 |
| 2015/0170612 | A1* | 6/2015 | Muguruma | G09G 3/3283 345/690 |
| 2015/0332630 | A1 | 11/2015 | Chang | |
| 2016/0055791 | A1* | 2/2016 | Kishi | G09G 3/30 345/212 |
| 2017/0318250 | A1* | 11/2017 | Sakakibara | H04N 5/378 |
| 2019/0238768 | A1* | 8/2019 | Yamada | H04N 5/37452 |
| 2021/0150994 | A1* | 5/2021 | Fukai | G06N 3/08 |

FOREIGN PATENT DOCUMENTS

| | | | |
|---|---|---|---|
| CN | 105427794 | A | 3/2016 |
| CN | 105741759 | A | 7/2016 |
| CN | 107293240 | A | 10/2017 |
| CN | 107492343 | A | 12/2017 |
| CN | 107886900 | A | 4/2018 |
| CN | 108766349 | A | 11/2018 |

OTHER PUBLICATIONS

PCT Written Opinion, Application No. PCT/CN2019/080113, dated Jun. 10, 2019, 6 pages.: with English translation of relevant part.
China First Office Action, Application No. 201810627050.0, dated Aug. 29, 2019, 18 pps.: with English translation.
China Second Office Action, Application No. 201810627050.0, dated Mar. 31, 2020, 19 pps.: with English translation.

* cited by examiner

PIXEL CIRCUITRY AND DRIVE METHOD THEREOF, ARRAY SUBSTRATE, AND DISPLAY PANEL

CROSS REFERENCE TO RELATED APPLICATIONS

This patent application is a National Stage Entry of PCT/CN2019/080113 filed on Mar. 28, 2019, which claims the benefit and priority of Chinese Patent Application No. 201810627050.0 filed on Jun. 19, 2018, the disclosures of which are incorporated by reference herein in their entirety as part of the present application.

BACKGROUND

The present disclosure relates to the field of display technologies, and more particularly, to a pixel circuitry and a drive method thereof, an array substrate, and a display panel.

With development of display technologies, a new generation of organic light emitting diode (OLED) display devices have advantages, such as lower manufacturing cost, faster response speed, higher contrast ratio, wider viewing angle, larger operating temperature range, brighter color, and lighter weight, and do not need backlight units, compared with conventional liquid crystal display (LCD) devices. Therefore, currently, the OLED display technologies have become the fastest-growing display technologies.

The current mainstream development direction of the OLED is to control the magnitude of the current between the source and the drain of a drive transistor by changing the gate voltage of the drive transistor directly driving the OLED to emit light, to implement variation of the light emission luminance. However, in the process of fabricating the drive transistors, the threshold voltages of the drive transistors may be different at different locations due to process variation. Furthermore, as the time goes on and the operating environment changes, the threshold voltage of the drive transistor may drift. In another aspect, in a display device, different locations where pixels are may also cause different voltage drops (I-R Drops) of a power source, which may affect the current driving the OLED.

BRIEF DESCRIPTION

Embodiments of the present disclosure provide a pixel circuitry and a drive method thereof, an array substrate, and a display panel.

A first aspect of the present disclosure provides a pixel circuitry. The pixel circuitry may include a data write-in circuit, an initialization circuit, a sense circuit, a first capacitor, a second capacitor, a drive transistor, and a data signal supply circuit. The data write-in circuit is configured to provide a data signal from a data line to a first node according to a first control signal from a first control signal terminal. The initialization circuit is configured to provide an initialization signal to a sense line according to a second control signal from a second control signal terminal. The sense circuit is configured to couple a second node to the sense line according to the first control signal, such that a voltage of the second node is equal to a voltage of the sense line. The first capacitor is configured to store a voltage difference between the first node and the second node. The second capacitor is configured to store the voltage of the sense line. A control electrode of the drive transistor is coupled to the first node, a first electrode of the drive transistor is coupled to a first voltage signal terminal, a second electrode of the drive transistor is coupled to the second node, and the drive transistor is configured to provide a drive current to a light emitting device. The data signal supply circuit is configured to read the voltage of the sense line according to a third control signal from a third control signal terminal, determine a threshold voltage of the drive transistor according to the read voltage, and correct an original data signal from a data signal terminal according to the threshold voltage to supply the corrected original data signal to the data line.

In some embodiments of the present disclosure, the data signal supply circuit may include a read circuit, a determination circuit, and a supply circuit. The read circuit is configured to read the voltage of the sense line according to the third control signal. The determination circuit is configured to determine the threshold voltage of the drive transistor according to the read voltage. The supply circuit is configured to correct the original data signal according to the threshold voltage to supply the corrected original data signal to the data line.

In some embodiments of the present disclosure, the data signal supply circuit may further include an analog-to-digital conversion circuit and a storage circuit. The analog-to-digital conversion circuit is configured to convert the threshold voltage to a digital signal. The storage circuit is configured to store the threshold voltage in the form of the digital signal.

In some embodiments of the present disclosure, the data write-in circuit may include a first transistor. A control electrode of the first transistor is coupled to the first drive signal terminal, a first electrode of the first transistor is coupled to the data line, and a second electrode of the first transistor is coupled to the first node.

In some embodiments of the present disclosure, the initialization circuit may include a second transistor. A control electrode of the second transistor is coupled to the second control signal terminal, a first electrode of the second transistor is coupled to the initialization signal, and a second electrode of the second transistor is coupled to the sense line.

In some embodiments of the present disclosure, the sense circuit may include a third transistor. A control electrode of the third transistor is coupled to the first control signal, a first electrode of the third transistor is coupled to the sense line, and a second electrode of the third transistor is coupled to the second node.

In some embodiments of the present disclosure, the pixel circuitry may further include a first reference circuit. The first reference circuit is configured to supply a first reference signal to the data line according to a fourth control signal from a fourth control signal terminal.

In some embodiments of the present disclosure, the first reference circuit may include a fourth transistor. A control electrode of the fourth transistor is coupled to the fourth control signal terminal, a first electrode of the fourth transistor is coupled to the first reference signal, and a second electrode of the fourth transistor is coupled to the data line.

In some embodiments of the present disclosure, the pixel circuitry may further include a second reference circuit. The second reference circuit is configured to supply a second reference signal to the sense line according to a fifth control signal from a fifth control signal terminal.

In some embodiments of the present disclosure, the second reference circuit may include a fifth transistor. A control electrode of the fifth transistor is coupled to the fifth control signal terminal, a first electrode of the fifth transistor is coupled to the second reference signal, and a second electrode of the fifth transistor is coupled to the sense line.

A second aspect of the present disclosure provides a method for driving the pixel circuitry according to the first aspect of the present disclosure. The method includes a non-display phase and a display phase. In the non-display phase, under control of a first control signal and a second control signal, a data signal from a data line is supplied to a first node, an initialization signal is supplied to a sense line, and a voltage of the sense line is ensured to be equal to a voltage of the second node. Under control of the first control signal, it is kept supplying the data signal to the first node, and under control of a voltage of the first node, a first capacitor and a second capacitor are charged by a drive current driving a drive transistor. Under control of a third control signal, the voltage of the sense line is read, and a threshold voltage of the drive transistor is determined according to the read voltage. In the display phase, an original data signal from the data signal terminal is corrected according to the threshold voltage to supply the corrected original data signal to the data line, and the data signal from the data line is supplied to the first node under control of a first control signal to drive the drive transistor to supply the drive current.

In some embodiments of the present disclosure, the method further includes in the non-display phase, supplying a first reference signal to the data line under control of the fourth control signal.

In some embodiments of the present disclosure, the method further includes in the display phase, supplying the second reference signal to the sense line under control of the fifth control signal.

In some embodiments of the present disclosure, a scan frequency of the non-display phase is lower than a scan frequency of the display phase.

A third aspect of the present disclosure provides an array substrate. The array substrate may include a plurality of pixel circuitries according to the first aspect of the present disclosure. A drive transistor, a data write-in circuit, a sense circuit, and a first capacitor of each of the pixel circuitries are arranged in an active display area of the array substrate. A second capacitor, an initialization circuit and a data signal supply circuit of each of the pixel circuitries are arranged in a peripheral area of the array substrate.

A fourth aspect of the present disclosure provides a display panel. The display panel includes the array substrate according to the third aspect of the present disclosure.

BRIEF DESCRIPTION OF THE DRAWINGS

To describe the technical solutions of the present disclosure more clearly, the accompanying drawings of the embodiments will be briefly introduced below. It is understood that the accompanying drawings in the following description merely involve some embodiments of the present disclosure, but do not limit the present disclosure, wherein the same reference numerals indicate the same elements or signals. In the drawings.

DETAILED DESCRIPTION

To make technical solutions and advantages of the embodiments of the present disclosure clearer, the technical solutions in the embodiments of the present disclosure will be described clearly and completely below, in conjunction with the accompanying drawings. Apparently, the described embodiments are merely some but not all of the embodiments of the present disclosure. All other embodiments obtained by those of ordinary skill in the art based on the described embodiments without creative efforts shall fall within the protection scope of the present disclosure.

In the description of the present disclosure, unless otherwise stated, term "a plurality of" means two or more; and the orientation or position relations represented by terms of "above", "beneath", "left", "right", "inside", "outside" and the like are orientation or position relations shown based on the accompanying figures, they are merely for the convenience of describing the embodiments of the present disclosure and simplifying the description instead of being intended to indicate or imply the device or element to have a special orientation or to be configured and operated in a special orientation. Thus, they cannot be understood as limiting of the present disclosure.

In the description of the present disclosure, it is to be noted that unless explicitly specified or limited otherwise, terms "installation", "connecting" or "coupling" should be understood in a broad sense, which may be, for example, a fixed connection, a detachable connection or integrated connection, a mechanical connection or an electrical connection, a direct connection or indirect connection by means of an intermediary. For those of ordinary skill in the art, specific meanings of the above terms in the present disclosure may be understood based on specific circumstances.

Figure 1:
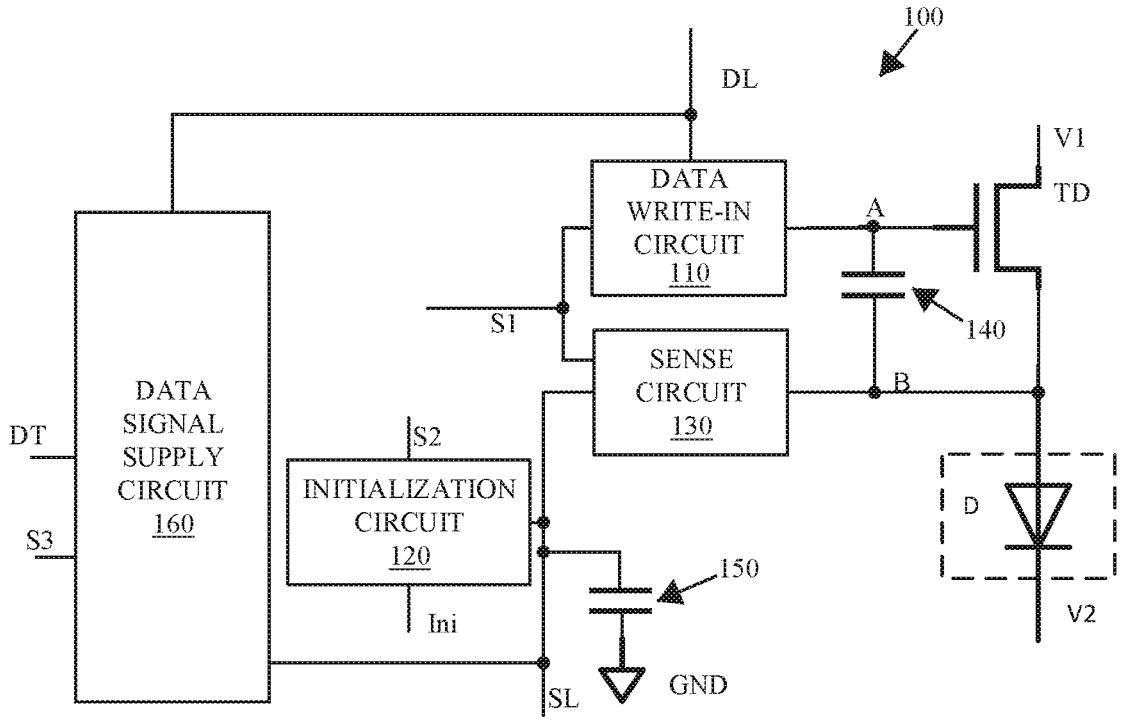
FIG. 1 illustrates a schematic block diagram of a pixel circuitry according to an embodiment of the present disclosure.

FIG. 1 illustrates a schematic block diagram of a pixel circuitry according to an embodiment of the present disclosure. As shown in FIG. 1, the pixel circuitry 100 may include a data write-in circuit 110, an initialization circuit 120, a sense circuit 130, a first capacitor 140, a second capacitor 150, a data signal supply circuit 160, and a drive transistor TD.

In some embodiments of the present disclosure, the data write-in circuit 110 may be coupled to a data line DL, a first control signal terminal S1, and a first node A. As shown in FIG. 1, the data write-in circuit 110 may be coupled to a control electrode (e.g., a gate) of the drive transistor TD via the first node A. The data write-in circuit 110 may supply a data signal VD from the data line DL to the first node A according to a first control signal G from the first control signal terminal S1 to control a voltage VA of the first node A.

The initialization circuit 120 may be coupled to a sense line SL, a second control signal terminal S2, and an initialization signal Ini. The initialization circuit 120 may supply the initialization signal Ini to the sense line SL according to a second control signal R from the second control signal terminal S2, to control a voltage $V_{SL}$ of the sense line SL by an initialization voltage $V_{ini}$.

The sense circuit 130 may be coupled to the sense line SL, the first control signal terminal S1, and a second node B. As shown in FIG. 1, the sense circuit 130 may be coupled to a second electrode (e.g., a source) of the drive transistor TD via the second node B. The sense circuit 130 may be configured to couple the second node B to the sense line SL according to the first control signal G, such that a voltage $V_B$ of the second node B is equal to the voltage $V_{SL}$ of the sense line SL.

The first capacitor 140 may be coupled between the first node A and the second node B. The first capacitor 140 may store quantity of electric charges between the first node A and the second node B, i.e., a voltage difference between the first node A and the second node B.

One end of the second capacitor 150 may be coupled to the sense line SL, and the other end of the second capacitor 150 may be grounded. The second capacitor 150 may store quantity of electric charges on the sense line SL, i.e., the voltage $V_{SL}$ of the sense line SL.

The control electrode of the drive transistor TD is coupled to the first node A, a first electrode of the drive transistor TD is coupled to a first voltage signal terminal V1, and the second electrode of the drive transistor TD is coupled to the second node B. The drive transistor TD may provide a drive current to a light emitting device according to the voltage $V_A$ of the first node A and the voltage $V_B$ of the second node B. In some embodiments of the present disclosure, the drive transistor TD is an N-type transistor. As shown in FIG. 1, the control electrode (i.e., the first node A) of the drive transistor TD is the gate, the first electrode of the drive transistor TD is a drain, and the second electrode (i.e., the second node B) of the drive transistor TD is the source. A gate-source voltage $V_{gs}$ of the drive transistor TD is the voltage difference between the voltage $V_A$ of the first node A and the voltage $V_B$ of the second node B. The drive transistor TD is enabled when the gate-source voltage $V_{gs}$ (i.e., $V_A-V_B$) of the drive transistor TD is above its threshold voltage $V_{th}$. The drive transistor TD is disabled when the gate-source voltage $V_{gs}$ (i.e., $V_A-V_B$) of the drive transistor TD is below its threshold voltage $V_{th}$. In some embodiments of the present disclosure, in the non-display phase, when the drive transistor TD is enabled, current in the drive transistor TD charges the first capacitor C1 and the second capacitor C2, such that the voltage $V_B$ of the second node B rises. When the voltage $V_B$ of the second node B rises to $V_A-V_{th}$, the gate-source voltage $V_{gs}$ is equal to the threshold voltage $V_{th}$ (i.e., $V_A-V_B=V_A-V_A+V_{th}=V_{th}$), and the drive transistor TD is disabled. In this situation, the voltage $V_{SL}$ of the sense line SL is equal to the voltage $V_B$ of the second node B, i.e., $V_A-V_{th}$.

The data signal supply circuit 160 may be coupled to the sense line SL, the data line DL, a third control signal terminal S3, and a data signal terminal DT. The data signal supply circuit 160 may read the voltage $V_{SL}$ of the sense line SL under the control of a third control signal P from the third control signal terminal S3, and calculate the threshold voltage $V_{th}$ of the drive transistor TD according to the data signal $V_D$ of the data line DL and the read voltage $V_{SL}$. Next, the data signal supply circuit 160 may correct an original data signal $V_{D0}$ from the data signal terminal DT according to the threshold voltage $V_{th}$ of the drive transistor TD, and supply the corrected data signal $V_{D1}$ to the data line DL to serve as a data signal on the data line DL for the next frame. In some embodiments of the present disclosure, the data signal supply circuit 160 may be disconnected (e.g., in a high impedance state) from the data line DL in the non-display phase to avoid having a negative effect on the data signal of the data line DL. In addition, the data signal supply circuit 160 may be disconnected (e.g., in a high impedance state) from the sense line SL in the display phase to avoid having a negative effect on the voltage of the sense line SL.

In some embodiments of the present disclosure, the voltage of the sense line SL read by the data signal supply circuit 160 is $V_A-V_{th}$. In this situation, the voltage $V_A$ of the first node A is equal to the voltage $V_D$ of the data signal of the data line DL under the control of the data write-in circuit 110. Thus, the threshold voltage $V_{th}$ of the drive transistor TD may be determined by calculating the voltage difference (i.e., $V_{th}=V_D-V_{SL}$) between the data signal $V_D$ of the data line and the read voltage $V_{SL}$. Furthermore, the original data signal $V_{D0}$ may be corrected by adding the threshold voltage $V_{th}$ to the original data signal $V_{D0}$ to obtain a corrected data signal $V_{D1}$ (i.e., $V_{D1}=V_{D0}+V_{th}$), and the corrected data signal $V_{D1}$ is supplied to the data line DL. Further, the drive transistor DT may supply a drive current according to the corrected data signal $V_{D1}$ from the data line DL.

Moreover, the pixel circuitry 100 may further include a light emitting device D (shown in a dashed box). An anode of the light emitting device D is coupled to the second electrode of the drive transistor TD, and a cathode of the light emitting device D is coupled to a second voltage signal terminal V2. The light emitting device D may emit light according to the drive current provided by the drive transistor TD. The light emitting device D is, for example, an OLED or the like.

According to some embodiments of the present disclosure, the pixel circuitry 100 may determine the threshold voltage of the drive transistor TD, and compensate for the original data signal $V_{D0}$ supplied by the data signal terminal DT. The drive current supplied by the drive transistor TD is associated with the voltage difference ($V_{gs}-V_{th}$) between the gate-source voltage $V_g$, and the threshold voltage $V_{th}$. According to calculation, $V_{gs}-V_{th}=V_A-V_B-V_{th}=V_{D1}-V_{SL}-V_{th}=V_{Do}+V_{th}-V_{SL}-V_{th}=V_{D0}-V_{SL}$. Therefore, when displaying, the drive current supplied by the drive transistor TD is only related to the original data signal $V_{D0}$ supplied by the data signal terminal DT and the voltage $V_{SL}$ of the sense line SL, without causing brightness inconsistency of pixels due to deviation of the threshold voltage or adverse effect of power supply voltage (for example, the first voltage signal VDD from the first voltage signal terminal V1 and the second voltage signal VSS from the second voltage signal terminal V2) caused by IR drop.

According to some embodiments of the present disclosure, electrical characteristics (e.g., a threshold voltage) of the drive transistor in the pixel circuitry can be determined, and the original data signal from the data signal terminal can be compensated for according to the determined electrical characteristics during display. Thus, the drive current provided by the drive transistor is irrelevant with its electrical characteristics, and therefore brightness differences between different pixel circuitries caused by differences in characteristics of the drive transistor can be eliminated.

Figure 2:
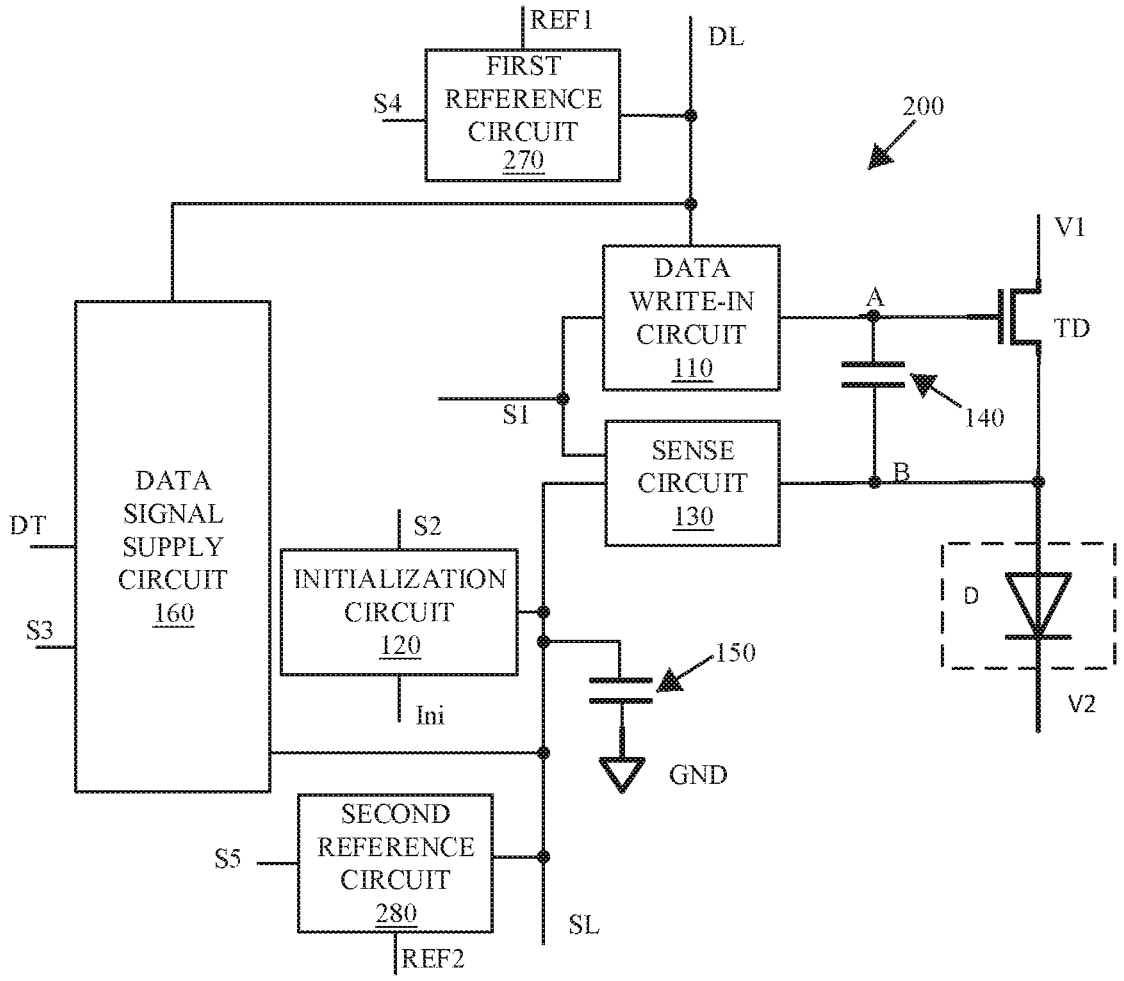
FIG. 2 illustrates a schematic block diagram of a pixel circuitry according to another embodiment of the present disclosure.

FIG. 2 illustrates a schematic block diagram of a pixel circuitry according to another embodiment of the present disclosure. As shown in FIG. 2, the pixel circuitry 200 may include a data write-in circuit 110, an initialization circuit 120, a sense circuit 130, a first capacitor 140, a second capacitor 150, a data signal supply circuit 160, a drive transistor TD, a first reference circuit 270, and a second reference circuit 280.

In some embodiments of the present disclosure, the first reference circuit 270 may be coupled to a fourth control signal terminal S4, the data line DL, and a first reference signal REF1. According to a fourth control signal S from the fourth control signal terminal S4, the first reference circuit 270 may supply, to the data line DL, the first reference signal REF1 as the data signal VD of the data line DL.

The second reference circuit 280 may be coupled to a fifth control signal terminal S5, the sense line SL, and a second reference signal REF2. The second reference circuit 280 may provide the second reference signal REF2 to the sense line SL according to a fifth control signal EM from the fifth control signal terminal S5 to control the voltage $V_{SL}$ of the sense line SL.

In another embodiment of the present disclosure, the first reference circuit 270 and the second reference circuit 280 may also be arranged separately from other portions of the pixel circuitry 200. For example, the first reference circuit 270 and the second reference circuit 280 may be arranged in a separate driver circuit. The driver circuit may include a processor and a memory, in which computer program instructions are stored. When executed by the processor, the computer program instructions cause the first reference signal REF1 to be provided to the data line DL according to the fourth control signal S from the fourth control signal terminal S4, and cause the second reference signal REF2 to be provided to the sense line SL according to the fifth control signal EM from the fifth control signal terminal S5.

Therefore, according to some embodiments of the present disclosure, the pixel circuitry can supply a stable voltage to the data line DL and the sense line SL at certain time. The driving method of the pixel circuitry will be described in detail below.

In addition, other parts of the pixel circuitry 200 in FIG. 2 is the same as the corresponding parts of the pixel circuitry 100 in FIG. 1 in structure. Thus, its detailed description can be omitted herein.

Furthermore, the first reference signal REF1 provided by the first reference circuit 270 may be supplied to the first node A via the data write-in circuit 110 to control the voltage $V_A$ of the first node A. The second reference signal REF2 provided by the second reference circuit 280 may be supplied to the second node B via the sense circuit 130 to control the voltage $V_B$ of the second node B.

Figure 3:
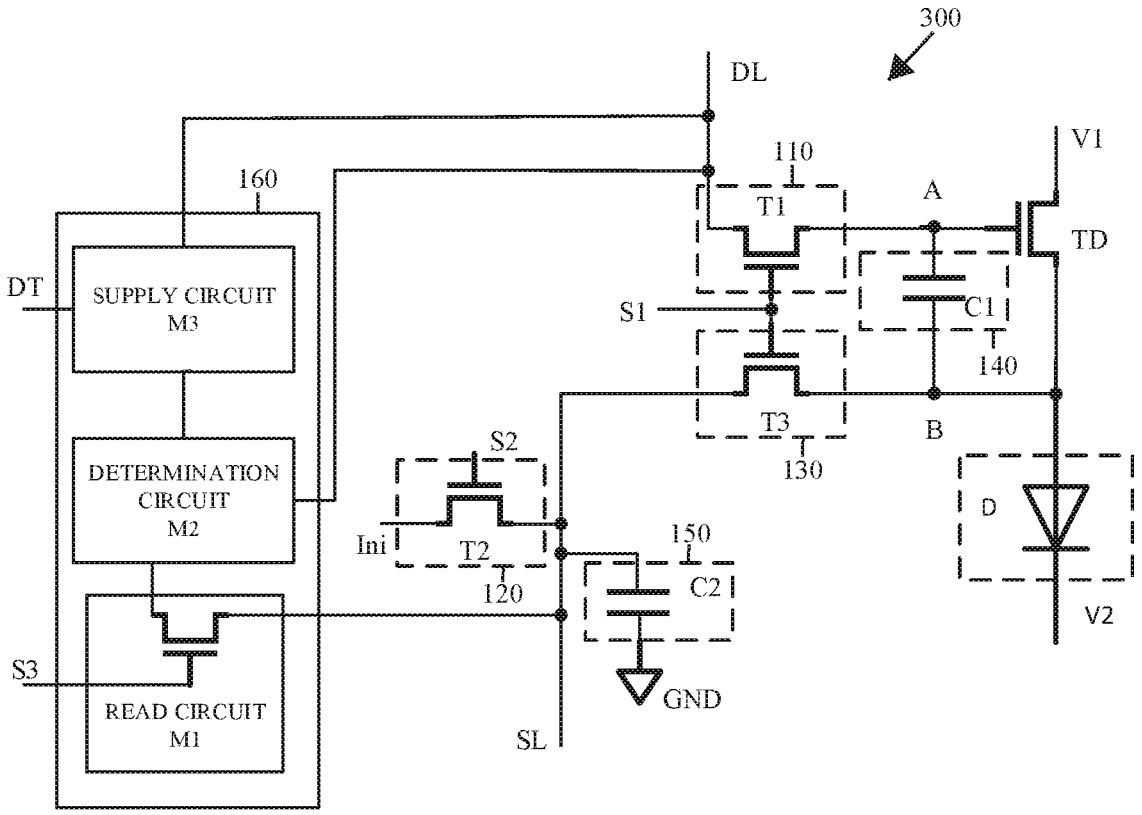
FIG. 3 illustrates an exemplary circuit diagram of a pixel circuitry as shown in FIG. 1.

FIG. 3 illustrates an exemplary circuit diagram of a pixel circuitry according to an embodiment of the present disclosure, wherein the pixel circuitry 300 may be, for example, the pixel circuitry 100 as shown in FIG. 1. In this embodiment, the transistor used may be an N-type transistor or a P-type transistor. Specifically, the transistor may be an N-type or a P-type field-effect transistor (MOSFET) or an N-type or a P-type bipolar transistor (BJT). In some embodiments of the present disclosure, a gate of the transistor is referred to as a control electrode. A source and a drain of the transistor are symmetrical, and thus the source and the drain are not distinguished. That is, the source of the transistor may be a first electrode (or a second electrode), and the drain of the transistor may be the second electrode (or the first electrode).

In some embodiments of the present disclosure, a detailed description can be made by taking the N-type field-effect transistor (NMOS) as an example.

As shown in FIG. 3, the data write-in circuit 110 may include a first transistor T1. The control electrode of the first transistor T1 is coupled to the first drive signal terminal S1, the first electrode of the first transistor T1 is coupled to the data line DL, and the second electrode of the first transistor T1 is coupled to the first node A. The first transistor T1 may supply the data signal $V_D$ from the data line DL to the first node A according to the first control signal G from the first control signal terminal S1.

The initialization circuit 120 may include a second transistor T2. The control electrode of the second transistor T2 is coupled to the second control signal terminal S2, the first electrode of the second transistor T2 is coupled to the initialization signal Ini, and the second electrode of the second transistor T2 is coupled to the sense line SL. Under the control of the second control signal R from the second control signal terminal S2, the second transistor T2 may supply, to the sense line SL, the initialization signal Ini as the initialized voltage $V_{SL}$ of the sense line SL.

The sense circuit 130 may include a third transistor T3. The control electrode of the third transistor T3 is coupled to the first control signal terminal S1, the first electrode of the third transistor T3 is coupled to the sense line SL, and the second electrode of the third transistor T3 is coupled to the second node B. Under the control of the first control signal G, the third transistor T3 may couple the second node B to the sense line SL, such that the voltage $V_B$ of the second node B is equal to the voltage $V_{SL}$ of the sense line SL. In this embodiment, in the initialization phase, the voltage $V_{SL}$ (i.e., the initialization signal Ini) of the sense line SL is supplied to the second node B to serve as the voltage $V_B$ of the second node B. In an establishment phase, the voltage $V_B$ of the second node B is transferred to the sense line SL to serve as the voltage $V_{SL}$ of the sense line SL. The initialization phase and the establishment phase will be described in detail hereinafter.

The first capacitor 140 may include a capacitor C1, and the second capacitor 150 may include a capacitor C2.

The structure of the drive transistor TD has been described above and thus will not be described in detail herein.

In some embodiments of the present disclosure, the data signal supply circuit 160 may include a read circuit M1, a determination circuit M2, and a supply circuit M3.

The read circuit M1 may read the voltage $V_{SL}$ of the sense line SL according to the third control signal P from the third control signal terminal S3, and supply the read voltage $V_{SL}$ to a first input terminal of the determination circuit M2. As shown in FIG. 3, the read circuit M1 is, for example, a fifth transistor, wherein the control electrode of the fifth transistor is coupled to the third control signal terminal S3, the first electrode of the fifth transistor is coupled to the sense line SL, and the second electrode of the fifth transistor is coupled to the first input terminal of the determination circuit M2.

The determination circuit M2 may determine the threshold voltage $V_{th}$ of the drive transistor TD according to the data signal $V_D$ of the data line DL and the read voltage $V_{SL}$, and supply the determined threshold voltage $V_{th}$ to the supply circuit M3. In this embodiment, the determination circuit M2 may include a subtractor. A first input terminal of the subtractor is coupled to the read circuit M1 to receive the read voltage $V_{SL}$, a second input terminal of the subtractor is coupled to the data line DL, and an output terminal of the subtractor is coupled to the supply circuit M3. The threshold voltage $V_{th}$ may be determined by calculating the voltage difference between the data signal $V_D$ and the read voltage $V_{SL}$.

In some embodiments of the present disclosure, the data signal supply circuit 160 may further include an analog-to-digital conversion circuit (not shown), such as an analog-to-digital converter (ADC), which converts the threshold voltage $V_{th}$ determined by the determination circuit M2 into a digital signal. Alternatively, the data signal supply circuit 160 may further include a storage circuit (not shown). The storage circuit may store the threshold voltage $V_{th}$ in the form of the digital signal. In some embodiments, the storage circuit may be any memory having a storage function, which stores the threshold voltage $V_{th}$ in the form of the digital signal at its address.

The supply circuit M3 may correct the data signal of the data line DL according to the determined (or stored) threshold voltage $V_{th}$ and the original data signal $V_{D0}$ from the data signal terminal DT, and supply the corrected data signal $V_{D1}$ to the data line DL. In an example, the supply circuit M3 may be implemented by an adder, wherein the first input terminal of the supply circuit M3 is coupled to the data signal terminal DT, the second input terminal of the supply circuit M3 is coupled to the determination circuit M2 (alternatively, the storage circuit) to receive the threshold voltage $V_{th}$, and the output terminal of the supply circuit M3 is coupled to the data line DL. The adder performs summation operation on the threshold voltage $V_th$ and the original data signal $V_{D0}$ to obtain a corrected data signal $V_{D1}$, and the corrected data signal $V_{D1}$ is outputted to the data line DL.

In some embodiments of the present disclosure, the data signal supply circuit 160 may also be implemented by a combination of software and hardware such as a processor. For example, the data signal supply circuit 160 may include a memory and a processor, wherein computer program instructions are stored in the memory. When the computer program instructions are executed by the processor to cause the data signal supply circuit 160 to read the voltage $V_{SL}$ of the sense line according to the third control signal P, to determine the threshold voltage $V_{th}$ (which may be converted into a digital signal and stored in the memory) of the drive transistor according to the data signal $V_D$ and the read voltage $V_{SL}$, and to supply the corrected data signal $V_{D1}$ to the data line DL according to the threshold voltage $V_{th}$ and the original data signal $V_{D0}$ from the data signal terminal DT.

Figure 4:
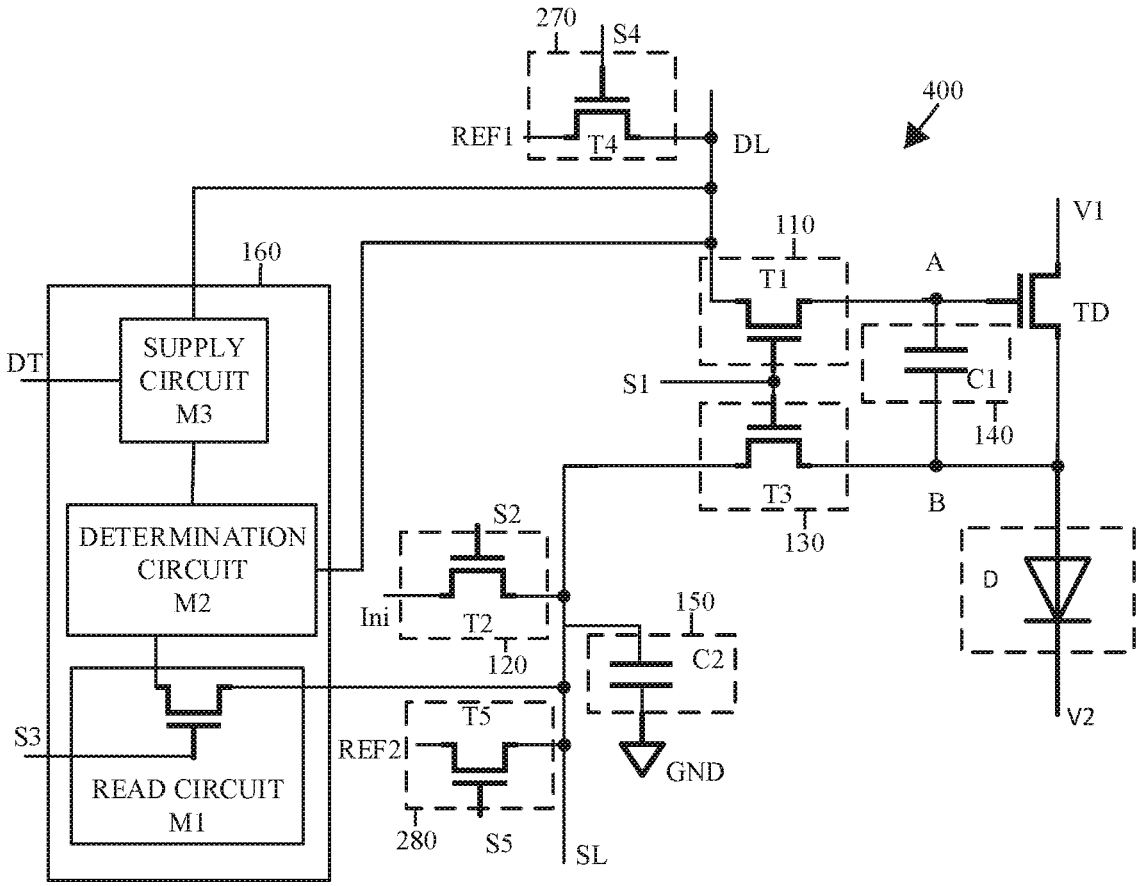
FIG. 4 illustrates an exemplary circuit diagram of a pixel circuitry as shown in FIG. 2.

FIG. 4 illustrates an exemplary circuit diagram of a pixel circuitry according to an embodiment of the present disclosure. The pixel circuitry 400 may be, for example, the pixel circuitry 200 as shown in FIG. 2. In this embodiment, the transistor used may be an N-type transistor or a P-type transistor. Specifically, the transistor may be an N-type or a P-type field-effect transistor (MOSFET) or an N-type or a P-type bipolar transistor (BJT). In some embodiments of the present disclosure, a gate of the transistor is referred to as a control electrode. A source and a drain of the transistor are symmetrical, and thus the source and the drain are not distinguished. That is, the source of the transistor may be a first electrode (or a second electrode), and the drain of the transistor may be the second electrode (or the first electrode).

In some embodiments of the present disclosure, a detailed description can be made by taking the N-type field-effect transistor (NMOS) as an example.

As shown in FIG. 4, in some embodiments of the present disclosure, in addition to the circuit structure of the pixel circuitry 300 as shown in FIG. 3, the pixel circuitry 400 may further include a first reference circuit 270 and a second reference circuit 280. The first reference circuit 270 may include a fourth transistor T4. A control electrode of the fourth transistor T4 is coupled to the fourth control signal terminal S4, a first electrode of the fourth transistor T4 is coupled to the first reference signal REF1, and a second electrode of the fourth transistor T4 is coupled to the data line DL. The first reference circuit 270 may supply the first reference signal REF1 to the data line DL under the control of the fourth control signal S from the fourth control signal terminal S4. The second reference circuit 280 may include a fifth transistor T5. A control electrode of the fifth transistor T5 is coupled to the fifth control signal terminal S5, a first electrode of the fifth transistor T5 is coupled to the second reference signal REF2, and a second electrode of the fifth transistor T5 is coupled to the sense line SL. The second reference circuit 280 may supply the second reference signal REF2 to the sense line SL under the control of the fifth control signal EM from the fifth control signal terminal S5.

In some embodiments of the present disclosure, reading the characteristics (i.e., determining the threshold voltage) of the drive transistor of the pixel circuitry and displaying normal pictures are two different phases, i.e., a non-display phase and a display phase. Orders of the non-display phase and the display phase are not specifically limited. For example, reading the characteristics may be performed before the time within which a display device normally displays first few frames to hundreds of frames, or may be performed in the non-display phase within which the display is completed and the display device is turned off, or may be performed either before or after the display phase.

Figure 5:
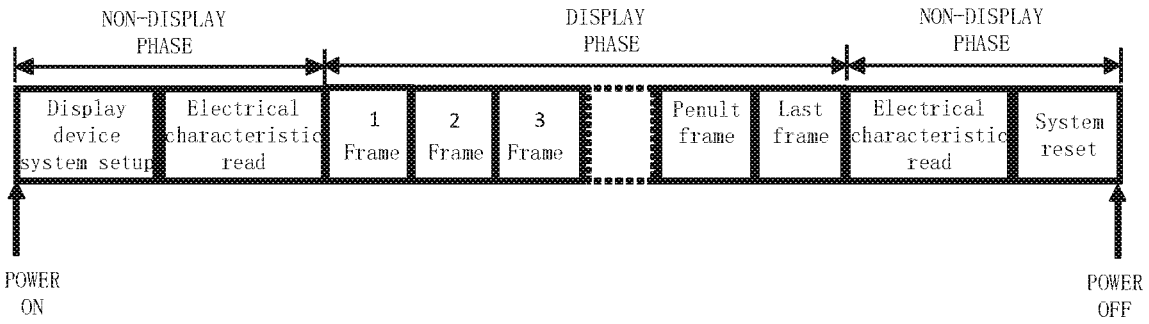
FIG. 5 illustrates an exemplary schematic diagram of a display system in a non-display phase and a display phase according to an embodiment of the present disclosure.

FIG. 5 illustrates an exemplary timing diagram of the non-display phase and the display phase according to an embodiment of the present disclosure. In this example, as shown in FIG. 5, the process, from the display device being turned on to the display being turned off, includes three phases, i.e., the non-display phase, the display phase, and the non-display phase.

The non-display phase from the display device being turned on to the display device displaying a normal picture may include a display device system setup phase and an electrical characteristic read (and save) phase. In the display device system setup phase, the power supply voltage can be set to a preset value, and a control signal and a timing sequence can be set for the display system. In the electrical characteristic read (and save) phase, values of the threshold voltages Vth of the drive transistors in pixels can be read, row by row, for the pixels, and the read values can be stored in a control device.

In the display phase, the data signal provided by the data signal terminal can be compensated for according to the determined threshold voltage, such that the display system can sequentially display the pictures according to a normal timing sequence. Therefore, compensation for a pixel voltage of a pixel can be implemented.

In the non-display phase from the display device displaying a normal picture to the display device being turned off, the electrical characteristic read (and save) phase and a system reset phase may be set again, and then the display device can be turned off.

Operation procedures of the pixel circuitry 300 and the pixel circuitry 400 provided by the embodiments of the present disclosure in the non-display phase and the display phase can be described in detail below.

Figure 6A:
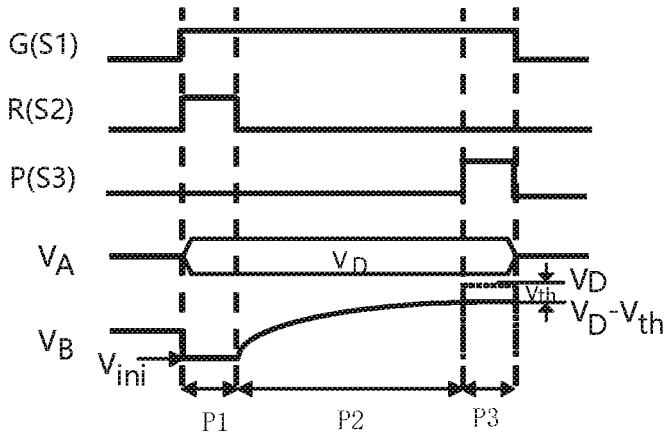
FIG. 6A illustrates a timing diagram of signals in the pixel circuitry as shown in FIG. 3 in the non-display phase.
Figure 6B:
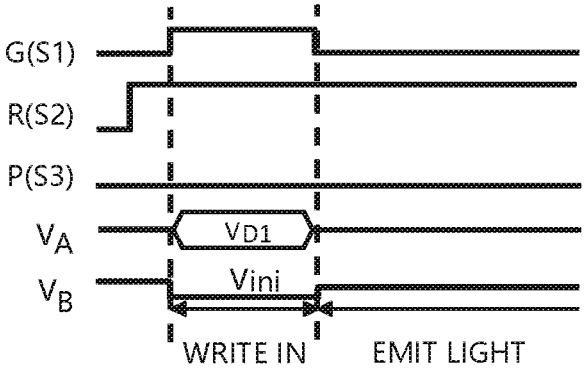
FIG. 6B illustrates a timing diagram of signals in the pixel circuitry as shown in FIG. 3 in the display phase.

FIG. 6A illustrates a timing diagram of signals in the pixel circuitry in the non-display phase according to an embodiment of the present disclosure, and FIG. 6B illustrates a timing diagram of signals in the pixel circuitry in the display phase according to an embodiment of the present disclosure. The pixel circuitry may be, for example, the pixel circuitry 300 as shown in FIG. 3. In some embodiments, the first voltage signal Vdd is a high level signal, and the second voltage signal Vss is a low level signal.

As shown in FIG. 6A, the non-display phase may correspondingly include an initialization phase P1, an establishment phase P2, and a read phase P3.

In the initialization phase P1, both the first control signal G and the second control signal R are at a high level, such that the first transistor T1, the second transistor T2, and the third transistor T3 are turned on. The data signal $V_D$ is supplied to the data line DL. For example, the data signal $V_D$ may be directly supplied to the data line DL via the data signal terminal DT (for example, other reference signals may also be supplied). The data signal $V_D$ of the data line DL is supplied to the first node A through the first transistor T1, such that the voltage $V_A$ of the first node is $V_D$. The initialization signal Ini (e.g., a low level signal, its voltage value may be denoted as $V_{ini}$) is supplied to the sense line SL via the second transistor T2, and is further supplied to the second node B via the third transistor T3. Therefore, during the initialization phase T1, the voltage $V_B$ of the second node B is $V_{ini}$. In this way, the voltages of the gate (i.e., the first node A) and the source (i.e., the second node B) of the drive transistor TD are initialized by the data signal $V_D$ and the initialization signal Ini, respectively. Furthermore, the first capacitor C1 may store the voltage difference (i.e., $V_D-V_{ini}$) between the first node A and the second node B. That is, the gate-source voltage $V_{gs}$ of the drive transistor TD is held by the first capacitor C1.

In the establishment phase P2, the first control signal G is held at a high level, whereas the second control signal R is at a low level. The first transistor T1 and the third transistor T3 both remain to be turned on, whereas the second transistor T2 is turned off. The voltage $V_A$ of the first node A is held at $V_D$. Current in the drive transistor TD charges the first capacitor C1 and the second capacitor C2, such that the voltage $V_B$ of the second node B and the voltage of the sense line SL gradually rise. Accordingly, the gate-source voltage $V_{gs}$ (i.e., $V_A-V_B$) of the drive transistor is decreased, and the current in the drive transistor TD is also correspondingly reduced. The drive transistor TD is turned off when the voltage of the sense line SL reaches the voltage difference between the data signal $V_D$ and the threshold voltage $V_{th}$ of the drive transistor TD. In this situation, it may be considered that the voltage of the sense line SL is approximate to $V_D-V_{th}$. In some embodiments of the present disclosure, the longer the period of the establishment phase T2 is, the closer the voltage of the sense line SL is to $V_D-V_{th}$.

In the read phase P3, the first control signal G is held at a high level, the first transistor T1 and the third transistor T3 both remain to be turned on, and the voltage $V_A$ of the first node A is held at $V_D$. As can be understood from the above, the voltage of the sense line is approximate to $V_D-V_{th}$. The third control signal P is at a high level, and the voltage ($V_D-V_{th}$) of the sense line SL is read by the read circuit M1. Next, the determination circuit M2 determines the threshold voltage $V_{th}$ of the drive transistor TD. For example, the determination circuit M2 may determine the threshold voltage $V_{th}$ of the drive transistor TD by calculating the voltage difference between the data signal $V_D$ and the voltage $V_{SL}$ read from the sense line, that is, $V_D-(V_D-V_{th})=V_{th}$. Alternatively, the analog-to-digital conversion circuit may convert the determined threshold voltage $V_{th}$ into a digital signal, and the storage circuit may store the threshold voltage $V_{th}$.

In some embodiments of the present disclosure, to ensure the stability of the data signal of the data line DL, the data signal supply circuit 160 may be disconnected from the data line DL in the non-display phase.

As shown in FIG. 6B, in the display phase, the second control signal R is held at a high level, and the second transistor T2 remains to be turned on. In the data write-in phase when the first control signal G is at a high level, both the first transistor T1 and the third transistor T3 are turned on. The initialization signal Ini is supplied to the sense line SL through the second transistor T2 (for example, other reference signals may also be supplied), and the initialization signal Ini is then transmitted to the second node B through the third transistor T3, such that the voltage $V_B$ of the voltage second node B is equal to the initialization voltage $V_{ini}$ of the initialization signal Ini. The supply circuit M3 receives the original data signal $V_{D0}$ from the data signal terminal DT and the determined (and stored) threshold voltage $V_{th}$ of the drive transistor TD, and supplies the corrected data signal $V_{D1}$ to the data line DL. For example, the corrected data signal $V_{D1}$ is obtained by adding the original data signal $V_{D0}$ and the threshold voltage $V_{th}$ together, that is, $V_{D1}=V_{D0}+V_{th}$. Further, the first transistor T1 supplies the data signal (i.e., the corrected data signal $V_{D1}$) of the data line DL to the first node A (i.e., the control electrode of the drive transistor TD), to control the drive transistor to supply a drive current. Therefore, the voltage $V_A$ of the first node is $V_{D1}=V_{D0}+V_{th}$. The current supplied by the drive transistor TD is expressed as follows:

$$I_D = \frac{1}{2}\mu C_{OX}\frac{W}{L}(V_{gs}-V_{th})^2 = \frac{1}{2}\mu C_{OX}\frac{W}{L}(V_{D1}-V_{ini}-V_{th})^2 = \frac{1}{2}\mu C_{OX}\frac{W}{L}(V_{D0}+V_{th}-V_{ini}-V_{th})^2 = \frac{1}{2}\mu C_{OX}\frac{W}{L}(V_{D0}-V_{ini})^2$$

wherein μ, Cox, W, and L are related to the material and the size of the drive transistor. Therefore, the current supplied by the drive transistor TD is only related to the original data signal $V_{D0}$ supplied by the data signal terminal DT and the initialization signal Ini.

Next, the light emitting device D may emit light according to the current supplied by the drive transistor TD.

In some embodiments of the present disclosure, to ensure stability of the voltage of the sense line SL, the data signal supply circuit 160 may be disconnected from the sense line SL in the display phase.

Thus, adverse effects of the threshold voltage of the drive transistor and the power supply voltage on the pixel circuitry may be prevented, according to the embodiments of the present disclosure.

It is to be understood by those skilled in the art that, the more sufficient the time of the establishment phase of the non-display phase is, the more accurate the read threshold voltage is. The first control signal is, for example, a line scan signal, so time for one line is related to frame frequency of the signal. Therefore, the scan frequency of the non-display phase may be set to be lower than the scan frequency of the display phase. For example, the scan frequency of the display phase may be set to 60 Hz, whereas the scan frequency of the non-display phase may be set to 10 Hz, or even 1 Hz.

Figure 7A:
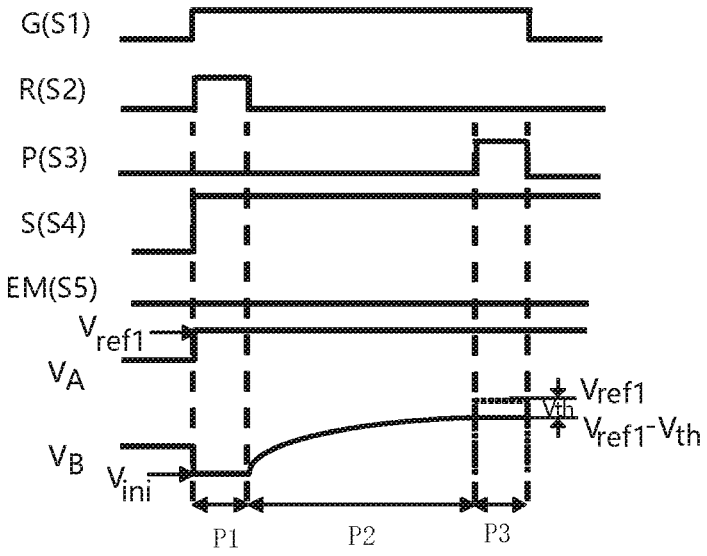
FIG. 7A illustrates a timing diagram of signals in the pixel circuitry as shown in FIG. 4 in the non-display phase.
Figure 7B:
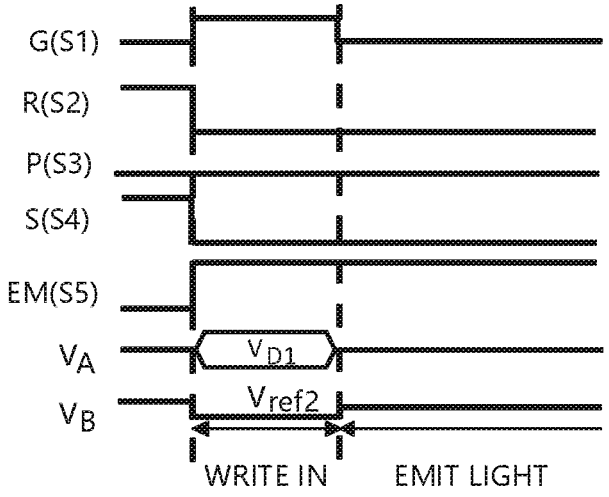
FIG. 7B illustrates a timing diagram of signals in the pixel circuitry as shown in FIG. 4 in the display phase.

FIG. 7A illustrates a timing diagram of signals in the pixel circuitry in the non-display phase according to an embodiment of the present disclosure, and FIG. 7B illustrates a timing diagram of signals in the pixel circuitry in the display phase according to an embodiment of the present disclosure. The pixel circuitry may be, for example, the pixel circuitry 400 as shown in FIG. 4. The first voltage signal Vdd is a high level signal, the second voltage signal Vss is a low level signal, and the initialization signal Vinit is a low level signal.

As shown in FIG. 7A, the non-display phase may also include an initialization phase P1, an establishment phase P2, and a read phase P3.

In the initialization phase P1, the fourth control signal S is supplied at a high level, and the first reference signal REF1 is supplied to the data line DL through the fourth transistor T4. Similar to the timing sequence of the signals as shown in FIG. 6A, the first reference signal REF1 of the data line DL is supplied to the first node A through the first transistor T1, such that the voltage $V_A$ of the first node A is equal to the voltage $V_{ref1}$ of the first reference signal. The initialization signal Ini is supplied to the second node B through the second transistor T2 and the third transistor T3, such that the voltage $V_B$ of the second node B is $V_{ini}$.

In the establishment phase P2, the voltage $V_A$ of the first node A is held at $V_{ref1}$, and the voltage $V_B$ of the second node B and the voltage $V_{SL}$ of the sense line SL gradually rise. The signal as shown in FIG. 7A is similar to the signal as shown in FIG. 6A in timing sequence, and thus its detail description can be omitted herein.

In the read phase P3, the voltage $V_{SL}$ of the sense line SL is read by the read circuit M1, that is, $V_{ref1}-V_{th}$. Next, the determination circuit M2 determines the threshold voltage $V_{th}$ according to the first reference signal ($V_{ref1}$) and the read voltage ($V_{ref1}-V_{th}$). Alternatively, the threshold voltage $V_{th}$ may be converted into a digital signal, and the converted digital signal may be stored in the storage circuit.

Furthermore, as shown in FIG. 7B, during the display phase, the fifth control signal EM at a high level is supplied. The fifth transistor T5 is turned on, and the second reference signal REF2 is supplied to the sense line SL. The voltage of the second reference signal REF2 is denoted by $V_{ref2}$. The second control signal R and the fourth control signal S are both held at a low level. The signals as shown in FIG. 7B are similar to the signals as shown in FIG. 6B in timing diagram, the drive current of the drive transistor is related to the voltage difference between the gate-source voltage $V_{gs}$ of the drive transistor and the threshold voltage $V_{th}$, that is, $V_{gs}-V_{th}=V_{D1}-V_{ref2}-V_{th}=V_{D0}+V_{th}-V_{ref2}-V_{th}=V_{D0}-V_{ref2}$.

As can be seen, according to the embodiments of the present disclosure, the drive current in the pixel circuitry 400 is only related to the original data signal and the second reference signal.

Then, the light emitting device emits light according to the drive current.

Figure 8:
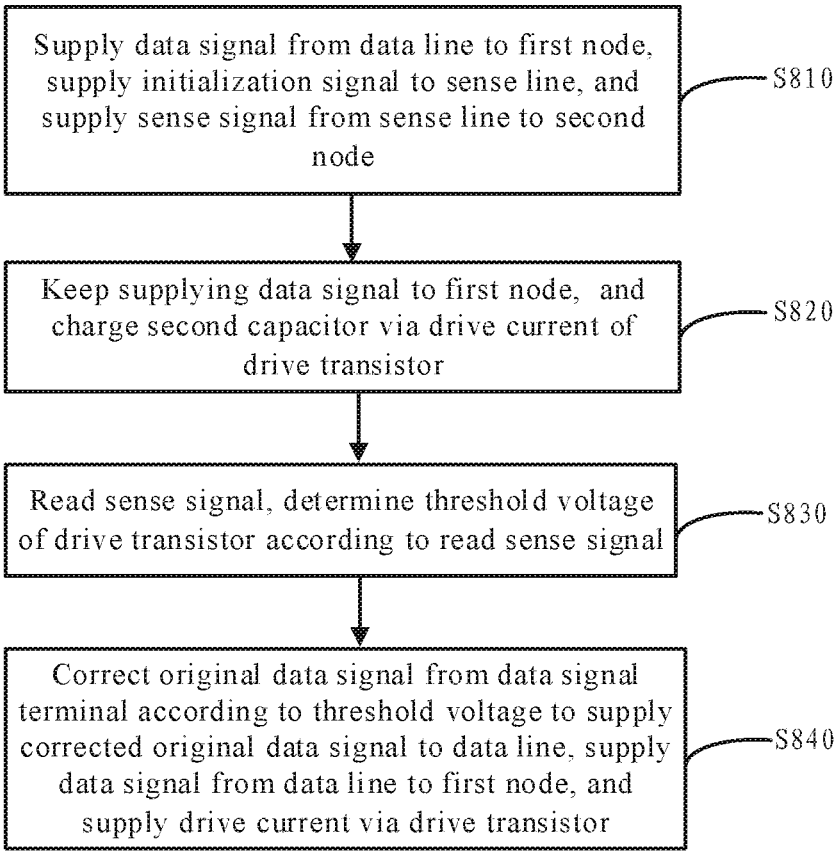
FIG. 8 illustrates a flowchart of a method for driving a pixel circuitry according to an embodiment of the present disclosure.

FIG. 8 illustrates a schematic flowchart of a method for driving a pixel circuitry according to an embodiment of the present disclosure.

As shown in FIG. 8, in Step S810, under the control of the first control signal and the second control signal, the data signal from the data line is supplied to the first node, the initialization signal is supplied to the sense line, and the second node is coupled to the sense line, such that the voltage of the sense line is equal to the voltage of the second node.

In Step S820, under the control of the first control signal, it is kept supplying the data signal to the first node. Under the control of the voltage of the first node, the drive current of the drive transistor charges the first capacitor coupled between the first node and the second node and the second capacitor coupled to the sense line.

In Step S830, under the control of the third control signal, the voltage of the sense line is read, and the threshold voltage of the drive transistor is determined according to the data signal and the read voltage. Alternatively, the determined threshold voltage may also be converted into a digital signal, and the converted digital signal is stored.

In some embodiments of the present disclosure, Step S810, Step S820, and Step S830 may be performed in a non-display phase. Alternatively, in the non-display phase, the first reference signal may be supplied to the data line under the control of the fourth control signal.

In Step S840, an original data signal from the data signal terminal is corrected according to the threshold voltage to supply the corrected original data signal to the data line, the data signal from the data line is supplied to the first node under the control of the first control signal, and the drive transistor is enabled to supply the drive current to the light emitting device.

In some embodiments of the present disclosure, the Step S840 may be performed in the display phase. Alternatively, in the display phase, the second reference signal may be supplied to the sense line under the control of the fifth control signal.

In some embodiments of the present disclosure, a scan frequency of the non-display phase is lower than that of the display phase.

It is to be understood by those skilled in the art that although the orders of the method for driving the pixel circuitry are represented by Step S810, Step S820, Step S830, and Step S840 in the embodiments of the present disclosure, this does not constitute a limitation on the embodiments of the present disclosure. The non-display phase (Step S810, Step S820, and Step S830) may be performed before and/or after the display phase (Step S840).

Figure 9:
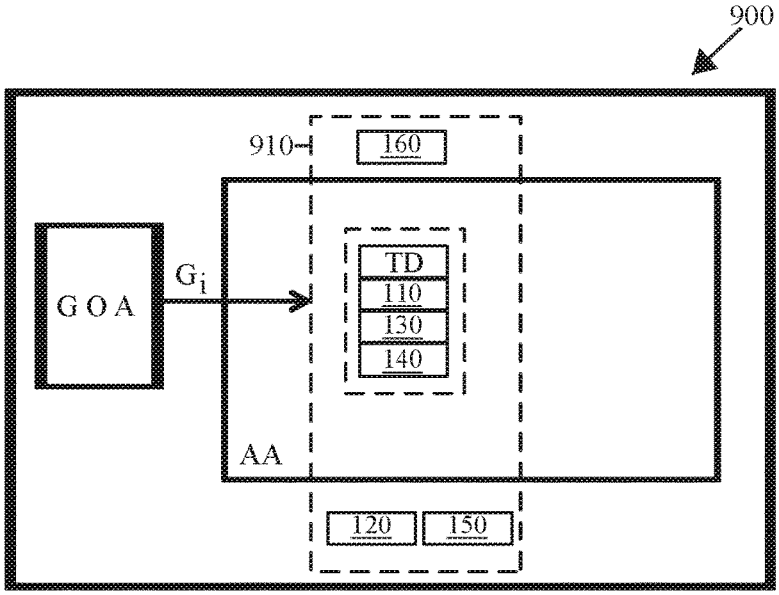
FIG. 9 illustrates a schematic diagram of an array substrate according to an embodiment of the present disclosure.

FIG. 9 illustrates a schematic diagram of an array substrate according to an embodiment of the present disclosure. The array substrate 900 may include a plurality of pixel circuitries according to an embodiment of the present disclosure. FIG. 9 only schematically illustrates a pixel circuitry 910, which may be, for example, the pixel circuitry 100 or the pixel circuitry 200. As shown in FIG. 9, the drive transistor TD, the data write-in circuit 110, the sense circuit 130, and the first capacitor 140 of each pixel circuitry are arranged in an active display area AA of the array substrate, and the second capacitor 150, the initialization circuit 120 and the data signal supply circuit 160 of each pixel circuitry are arranged in a peripheral area of the array substrate. Furthermore, the first reference circuit 270 and the second reference circuit 280 may also be arranged in the peripheral area of the array substrate.

In some embodiments of the present disclosure, the data signal supply circuit 160 may also be arranged on a backplane circuit other than the array substrate, and may be connected to other portions of the pixel circuitry through corresponding interfaces.

In some embodiments, a plurality of pixel circuitry portions within the active display area AA may be arranged in the shape of a matrix.

In some embodiments of the present disclosure, the array substrate 900 may further include cascaded shift register units (GOA). Each shift register unit provides the first control signal to pixel circuitries in the same row. Pixel circuitries in the same column are coupled to the same data line DL and the same scan line SL.

In some embodiments of the present disclosure, since the portion of the pixel circuitry in the active display area only has three transistors and one capacitor, wires may be arranged with implementing a higher resolution.

According to some embodiments of the present disclosure, deviation and drift of the threshold voltages of the drive transistors of the plurality of pixel circuitries may be compensated for, and brightness difference caused by IR drop between a remote end and a near end of a power source may be compensated for. Thus display uniformity and display quality may be improved.

Figure 10:
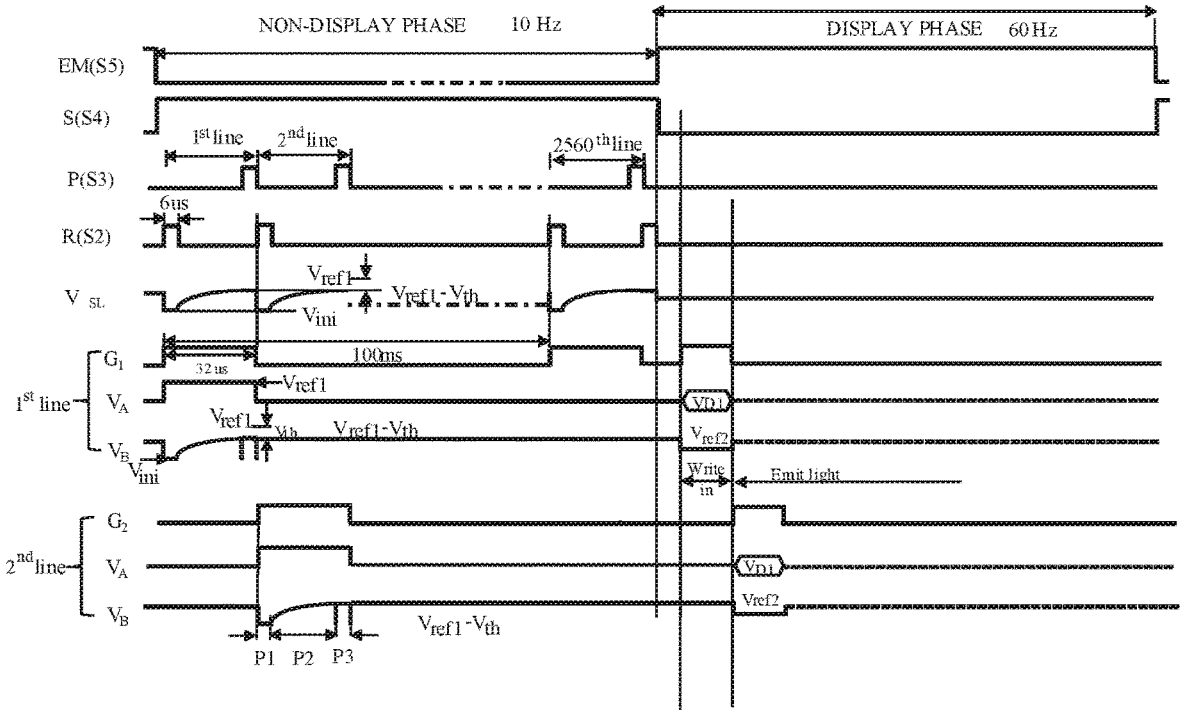
FIG. 10 illustrates an exemplary timing diagram of signals in an array substrate according to an embodiment of the present disclosure.

Taking an example where the pixel circuitry on the array substrate is the pixel circuitry 400 in FIG. 4, FIG. 10 illustrates an exemplary timing diagram of signals in the array substrate according to an embodiment of the present disclosure.

As shown in FIG. 10, the first control signals G at a high level are supplied to the pixel circuitries row by row. For example, the first control signal G1 is supplied to the first row of pixel circuitries, and the first control signal G2 is supplied to the second row of pixel circuitries. The timing sequences of the signal of the pixel circuitry in the non-display phase and the display phase have been described above, and thus are not described in detail herein.

In another aspect, the embodiments of the present disclosure also provide a display panel including the above array substrate and a display apparatus including the display panel. The display device may be, for example, a display screen, a mobile phone, a tablet computer, a camera, and a wearable apparatus, etc.

A plurality of embodiments of the present disclosure are described in detail above. However, the scope of protection of the present disclosure is not limited thereto. Apparently, those of ordinary skill in the art may make various modifications, substitutions, and variations on some embodiments of the present disclosure without departing from the spirit and scope of the present disclosure. The scope of protection of the present disclosure is limited by the appended claims.

What is claimed is:

1. A pixel circuitry comprising:

a data write-in circuit configured to provide a data signal from a data line to a first node according to a first control signal from a first control signal terminal;

an initialization circuit configured to provide an initialization signal to a sense line according to a second control signal from a second control signal terminal;

a sense circuit configured to couple a second node to the sense line according to the first control signal, such that a voltage of the second node is equal to a voltage of the sense line;

a first capacitor configured to store a voltage difference between the first node and the second node;

a second capacitor configured to store the voltage of the sense line;

a drive transistor, wherein a control electrode of the drive transistor is coupled to the first node, wherein a first electrode of the drive transistor is coupled to a first voltage signal terminal, wherein a second electrode of the drive transistor is coupled to the second node, and wherein the drive transistor is configured to provide a drive current to a light emitting device; and a data signal supply circuit configured to: read the voltage of the sense line according to a third control signal from a third control signal terminal, determine a threshold voltage of the drive transistor according to the read voltage, and correct an original data signal from a data signal terminal according to the threshold voltage to supply the corrected original data signal to the data line.

2. The pixel circuitry according to claim 1, wherein the data signal supply circuit comprises:

a read circuit configured to read the voltage of the sense line according to the third control signal;

a determination circuit configured to determine the threshold voltage of the drive transistor according to the read voltage; and a supply circuit configured to correct the original data signal according to the threshold voltage to supply the corrected original data signal to the data line.

3. The pixel circuitry according to claim 2, wherein the data signal supply circuit further comprises:

an analog-to-digital conversion circuit configured to convert the threshold voltage to a digital signal; and a storage circuit configured to store the threshold voltage in the form of the digital signal.

4. The pixel circuitry according to claim 2, further comprising:

a first reference circuit configured to supply a first reference signal to the data line according to a fourth control signal from a fourth control signal terminal.

5. The pixel circuitry according to claim 2, further comprising:

a second reference circuit configured to supply a second reference signal to the sense line according to a fifth control signal from a fifth control signal terminal.

6. The pixel circuitry according to claim 1, wherein the data write-in circuit comprises:

a first transistor, wherein a control electrode of the first transistor is coupled to the first control signal terminal, wherein a first electrode of the first transistor is coupled to the data line, and wherein a second electrode of the first transistor is coupled to the first node.

7. The pixel circuitry according to claim 1, wherein the initialization circuit comprises:

a second transistor, wherein a control electrode of the second transistor is coupled to the second control signal terminal, wherein a first electrode of the second transistor is coupled to the initialization signal, and wherein a second electrode of the second transistor is coupled to the sense line.

8. The pixel circuitry according to claim 1, wherein the sense circuit comprises:

a third transistor, wherein a control electrode of the third transistor is coupled to the first control signal, wherein a first electrode of the third transistor is coupled to the sense line, and wherein a second electrode of the third transistor is coupled to the second node.

9. The pixel circuitry according to claim 1, further comprising:

a first reference circuit configured to supply a first reference signal to data line according to a fourth control signal from a fourth control signal terminal.

10. The pixel circuitry according to claim 9, wherein the first reference circuit comprises:

a fourth transistor, wherein a control electrode of the fourth transistor is coupled to the fourth control signal terminal, wherein a first electrode of the fourth transistor is coupled to the first reference signal terminal, and wherein a second electrode of the fourth transistor is coupled to the data line.

11. The pixel circuitry according to claim 1, further comprising:

a second reference circuit configured to supply a second reference signal to the sense line according to a fifth control signal from a fifth control signal terminal.

12. The pixel circuitry according to claim 11, wherein the second reference circuit comprises:

a fifth transistor, wherein a control electrode of the fifth transistor is coupled to the fifth control signal terminal, wherein a first electrode of the fifth transistor is coupled to the second reference signal, and wherein a second electrode of the fifth transistor is coupled to the sense line.

13. A method for driving the pixel circuitry according to claim 1, the method comprising:

in a non-display phase:

under control of a first control signal and a second control signal, supplying a data signal from a data line to a first node, supplying an initialization signal to a sense line, and ensuring a voltage of the sense line to be equal to a voltage of the second node;

under control of the first control signal, keeping supplying the data signal to the first node, and under control of a voltage of the first node, charging a first capacitor and a second capacitor by a drive current driving a drive transistor;

under control of a third control signal, reading the voltage of the sense line, and determining a threshold voltage of the drive transistor according to the read voltage; and in a display phase, correcting an original data signal from the data signal terminal according to the threshold voltage to supply the corrected original data signal to the data line, and supplying the data signal from the data line to the first node under control of a first control signal to drive the drive transistor to supply the drive current.

14. The method according to claim 13, wherein the pixel circuitry comprises a first reference circuit, wherein the first reference circuit is configured to supply a first reference signal to the data line according to a fourth control signal from a fourth control signal terminal, the method further comprising:

in the non-display phase, supplying a first reference signal to the data line under control of the fourth control signal.

15. The method according to claim 13, wherein the pixel circuitry comprises a second reference circuit, wherein the second reference circuit is configured to supply a second reference signal to the sense line according to a fifth control signal from a fifth control signal terminal, the method further comprising:

in the display phase, supplying the second reference signal to the sense line under control of the fifth control signal.

16. The method according to claim 13, wherein a scan frequency of the non-display phase is lower than a scan frequency of the display phase.

17. An array substrate, comprising a plurality of pixel circuitries according to claim 1, wherein a drive transistor, a data write-in circuit, a sense circuit, and a first capacitor of each of the pixel circuitries are arranged in an active display area of the array substrate; and a second capacitor, an initialization circuit, and a data signal supply circuit of each of the pixel circuitries are arranged in a peripheral area of the array substrate.

18. A display panel comprising an array substrate according to claim 17.

19. The array substrate according to claim 17, wherein the data signal supply circuit comprises:

a read circuit configured to read the voltage of the sense line according to the third control signal;

a determination circuit configured to determine the threshold voltage of the drive transistor according to the read voltage; and a supply circuit configured to correct the original data signal according to the threshold voltage to supply the corrected original data signal to the data line.

20. The array substrate according to claim 19, wherein the data signal supply circuit further comprises:

an analog-to-digital conversion circuit configured to convert the threshold voltage to a digital signal; and a storage circuit configured to store the threshold voltage in the form of the digital signal.

* * * * *